United States Patent [19]

Bassler et al.

[11] Patent Number: 4,938,659

[45] Date of Patent: Jul. 3, 1990

[54] FUEL PUMP

[75] Inventors: Helmut Bassler, Waiblingen; Ulrich Kemmner, Stuttgart, both of Fed. Rep. of Germany

[73] Assignee: Robert Bosch GmbH, Stuttgart, Fed. Rep. of Germany

[21] Appl. No.: 623,486

[22] Filed: Jun. 22, 1984

[30] Foreign Application Priority Data

Aug. 3, 1983 [DE] Fed. Rep. of Germany ..... 3327922

[51] Int. Cl.[5] ..... F04D 5/00

[52] U.S. Cl. ..... 415/55.1

[58] Field of Search ..... 415/53 T, 198.2, 213 T

[56] References Cited

U.S. PATENT DOCUMENTS

| | | | |
|---|---|---|---|
| 2,340,787 | 2/1944 | Zenner et al. | 415/213 T X |
| 2,724,338 | 11/1955 | Roth | 415/53 T X |
| 3,259,072 | 7/1966 | Carpenter | 415/53 T |
| 3,558,236 | 1/1971 | Bylsma | 415/53 T |
| 4,194,360 | 3/1980 | Stieger | 415/53 T X |
| 4,493,620 | 1/1985 | Takei et al. | 415/53 T |

FOREIGN PATENT DOCUMENTS

| | | | |
|---|---|---|---|
| 2612118 | 1/1976 | Fed. Rep. of Germany | 415/53 T |

OTHER PUBLICATIONS

"Die Kreiselpumpen für Flüssigkeiten und Gase" by Carl Pfleiderer, Springer Verlag, 1961, pp. 615,616.

*Primary Examiner*—Robert E. Garrett

*Attorney, Agent, or Firm*—Michael J. Striker

[57] ABSTRACT

In a peripheral fuel-conveying pump, in which the rotatable impeller, provided with a plurality of vanes spaced from each other by grooves, is enclosed with the housing of the pump so that a fuel-feeding passage is formed between the inner wall of the housing and the periphery of the impeller. The dimensions of the fuel-feeding passage are defined by the first geometric characteristic $R_m$ which is a ratio between S and L, wherein S is the cross-sectional area of the space enclosed between the housing wall, defining the feeding passage, and the periphery of the impeller, and L is the length of the periphery of the portion of the impeller inserted into the fuel-feeding passage. $R_m$ must be in the range of 0.4–2 mm. The dimensions of the fuel-feeding passage are also limited by the second geometric characteristic $R_s=B/E$ and the third geometric characteristic $RA=B/E$, which must be in the range of 0.5–1.5, and wherein B is the width of the impeller in the axial direction, E is the height of each vane, $A_1$ is the sum of the cross-sectional areas of the portions of space S positioned laterally of the impeller and $A_2$ is the cross-sectional area of the remaining portion of space S.

2 Claims, 2 Drawing Sheets

FIG. 1 M10:1
PRIOR ART
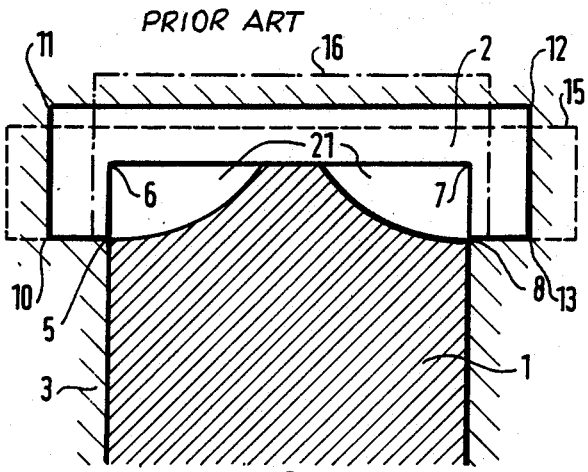
Rm = 1,2mm
L = 8,5mm Rs = 4,8
S = 10,2 mm² Ra = 3,2
PRIOR ART
FIG. 2 M10:1
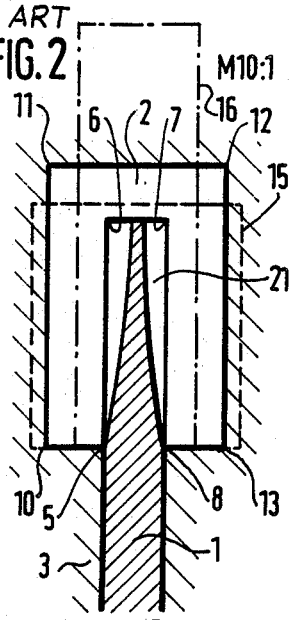
Rm = 1,2mm
L = 8,5mm Rs = 0,27
S = 10,2 mm² Ra = 0,36
FIG. 3 M 10:1
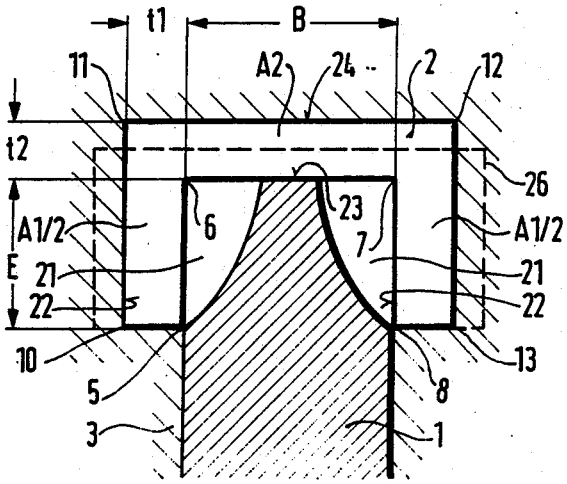
Rm = 1,2 mm
L = 8,5 mm Rs = 1,4
S = 10,2 mm² Ra = 1,1
FIG. 4
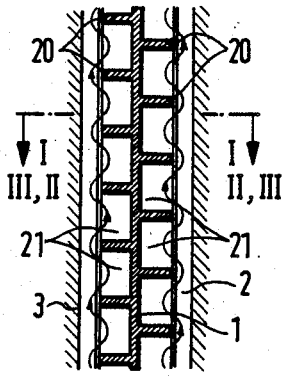

FUEL PUMP

BACKGROUND OF THE INVENTION

The present invention pertains to a fuel-supplying aggregate, for example for supplying fuel in a motor vehicle.

Fuel-supplying aggregates of the foregoing type have been known. Such fuel-supplying aggregates have been utilized in motor vehicles for supplying liquid fuel from a fuel container under high pressure to an internal combustion engine. Such a fuel-supplying aggregate is an electrically driven fuel pump which is used for pumping fuel from the fuel tank to the vehicle engine under a relatively high pumping pressure from 2 to 3 kg/cm$^2$ and with a relatively small pumping speed from 40 to 150 l/h.

Even more particularly, the invention relates to a feedback or side passage pump with enclosed vanes or WESTCO-type pump, which operates according to the peripheral or WESTCO principle. Such a pump is disclosed, for example in German patent publication DE No. 3,209,763Al or U.S. Pat. No. 3,259,072. According to the WESTCO principle the optimization of the pump operation is realized by the outer diameter of the impeller, equal approximately to 20–65 mm and a geometric characteristic of the pump Rm=S/L which lies approximately within the range of 0.4 to 2 mm, wherein S is an enclosed cross-sectional area between the feeding passage wall and the periphery of the impeller and L is the length of the periphery of the portion of the impeller immersed in the feeding passage. The geometric characteristic or index Rm can ensure designing of the shape of the fuel-feeding passage and the impeller so that a very large play can be defined therebetween.

The description of the prior art WESTCO pump operation will be now given with the reference to FIGS. 1 and 2. The impeller 1 shown in FIG. 1, can be, for example very wide with a small radial extension of the vanes while the impeller, shown in FIG. 2, is very narrow with a great depth of immersion into a fuel-feeding passage 2. The fuel-feeding passage 2 and impeller 1 are enclosed with a pump housing 3. Thereby the length of the periphery of the portion of the impeller, immersed in the fuel feeding passage 2 is defined by points 5, 6, 7 and 8 on the impeller. The cross-sectional area 5 is at the one side defined by points 10, 11, 12 and 13 on the fuel-feeding passage 2 and at the other side by points 5, 6, 7 and 8 on the impeller 1.

On the scale M=10:1, the peripheral length L in FIG. 1 is about 8.5 mm and the cross-sectional area 5 is about 10.2 mm$^2$. Therefore the uniform geometric characteristic value $R_m$=1.2 mm. The differently configurated fuel feeding passages 2 can be formed: for example, fuel conveying passages designated by reference characters 15, 16 in FIGS. 1 and 2 are defined by dotted lines, or they can be formed in any other manner, but always under assumption that the required geometric ratio or value $R_m$ is within the range of approximately between 0.4 and 2 mm. Such designs of the pumps, however do not provide optimal pump effects. The designing of the pumps with taking into consideration of this so-called first characteristic geometric value $R_m$ is not sufficient to construct optimally operating pumps.

SUMMARY OF THE INVENTION

It is an object of the present invention to provide an improved pump operated according to WESTCO principle.

It is another object of the present invention to provide a pump of an optimal pumping efficiency.

The advantage of the fuel-feeding pump according to the invention resides in that for obtaining an optimal efficiency of the pump a predetermined limitation of the pump dimensions is proposed.

The above noted and the other objects of the invention are attained by a fuel-pumping aggregate of the type having a housing accommodating drive means and pump means driven by said drive means and operating according to peripheral principle, said pump means including a rotatable impeller having a central axis and an outer peripheral portion having a periphery, said outer peripheral portion being provided with a plurality of vanes uniformly spaced from each other, said housing having an inner wall, said outer peripheral portion extending towards said inner wall and being spaced therefrom so that a fuel feeding passage is defined therebetween, said outer portion being immersed into said fuel feeding passage a distance corresponding to the height of each vane so that said inner housing wall in the region of said passage has an axial wall portion extended in the axial direction of the impeller and two lateral wall portions extended in the radial direction of the impeller, wherein hydraulic characteristics of said pump means are defined by a first pump geometric characteristic $R_m$=S/L lying within the range of approximately from 0.4 to 2 mm, wherein S is a cross-sectional area of a space enclosed between the inner wall of the housing and the periphery of said outer portion and L is the length of the periphery of said outer portion, and wherein hydraulic characteristics of the pump means are further defined by a second pump geometric characteristic $R_s$=B/E, and a third pump geometric characteristic $R_a$=A2/A1 which lie within the range of approximately 0.5 to 1.5, wherein B is the width of the impeller in the axial direction thereof;

E is the height of each vane, $A_1$ is the sum of the cross-sectional areas of two portions of said surface extended laterally of said outer portion of the impeller; and $A_2$ is the cross-sectional area of a remaining portion of said space, the cross-sectional area of each of said two portions being defined by the product of the height of the vane and a distance $t_1$ defined in said axial direction between the impeller and one of said lateral wall portions, and the cross-sectional area $A_2$ being defined by the product of a distance $t_2$, defined in said radial direction between an end radial face of the impeller and said axial wall portion, and the sum of the width of the impeller and two distances $t_1$.

The distance $t_1$ and the distance $t_2$ may be approximately equal to each other.

Due to the definition of predetermined limitations of the configurations of the fuel-conveying passage hydraulic characteristics of the rump are substantially improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIGS. 1 and 2 show, on scale M10:1, the shapes of the impeller and the fuel-feeding passage of the prior art pump;

FIG. 3 is a partial sectional view, on scale M10:1, showing a portion of the impeller extended into the fuel-feeding passage, according to the invention;

FIG. 4 is a top plan view of the impeller in the fuel-feeding passage of the pump housing, on a different scale.

DETAILED DESCRIPTION OF THE PREFERRED EMBODIMENTS

Figure 5:
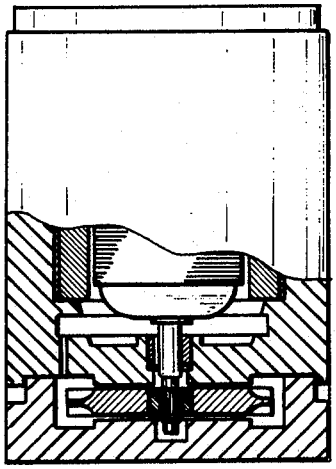
FIG. 5 is a schematic view, particularly in section, of the aggregate with drive means and pump means.

The fuel pump includes a substantially cylindrical housing, the inner wall 12 of which is only shown in FIG. 3, and a commonly known electric drive, such as electric motor, operated to rotate the impeller 1 having a plurality of vanes in the known fashion. The so-called driven pump portion includes the housing portion, the inner wall 12 of which encloses the peripheral wall of the impeller so that a fluid through passage is formed between that inner wall and the periphery of the impeller and the portion of the impeller is immersed in the fluid through passage. The so-called impeller with enclosed vanes is normally used in the pump which operates according to WESTCO principle for supplying fuel in a fuel supply device of an internal combustion engine of a motor vehicle. Since such a pump and its operation is known and is described, for example in the above noted German publication No. 32 09 763 the detailed description of such a pump is not given herein. FIGS. 3 and 4 illustrate only the portion of the peripheral pump in which the impeller 1, driven by the electric motor, has in the known fashion in the region of its periphery a number of vanes which are uniformly spaced from each other so that they include between each other vane grooves 21. As has been explained with reference to FIGS. 1 and 2, the impeller partially extends into the fuel feeding passage 2 formed between the inner wall 12 of the housing 3 of the pump and the peripheral surface of the impeller 1. The length of the periphery of the outer surface of the impeller is defined by points 5, 6, 7 and 8 and is about 8.5 mm on scale M 10:1. The cross-sectional area enclosed between the inner wall 12 of the housing defining the fuel-feeding passage and the periphery of the impeller 1 is defined between points 5, 6, 7, 8, 10, 11, 12 and 13 and is about 10.2 $mm^2$ on scale M 10:1. In the preferred embodiment, shown in FIGS. 3 and 4, the so-called first geometric characteristic or index $R_m=S/L$ is about 1.2 mm similarly to that of the known peripheral pump illustrated in FIGS. 1 and 2.

The pump according to the invention as shown in FIG. 3 however optimizes and provides for specifically favorable hydraulic characteristics because a second geometric characteristic or index $R_s=B/E$ and a third geometric characteristic or index $R_a=A_2/A_1$ are defined in the pump, which characteristics lie within the range of approximately between 0.5 and 1.5. B is the axial width of impeller 1 and E is the height of each vane in the radial direction of the impeller or the depth of immersion of impeller 1 into fuel feeding passage 2. $A_1$ is a sum of two cross-sectional areas positioned laterally of the impeller 1, particularly laterally of its vanes 20. Each of two cross-sectional areas constituting the cross-sectional area $A_1$ is defined by the product of the radial height E of the vane and the distance $t_1$ in the axial direction of impeller 1 between impeller 1 and the lateral wall 22 of the housing defining the lateral wall of fuel feeding passage 2. A2 is the remaining portion of the cross-sectional area S, which is defined by the product of distance $t_2$ in the radial direction of the impeller, between the periphery wall 23 of the impeller 1 and the wall 24 of the pump housing, extended in the axial direction and the sum of width B and two intervals $t_1$ extended in the axial direction of the impeller. Thereby the respective portions of the peripheral fuel stream with impulse exchange in the lateral or side passages 21, as well as the dragging fuel stream in the feeding passage 2, are set in a predetermined favorable relationship with each other because, in the case of a uniform peripheral speed of the impeller, the distribution of the cross-sectional area S about the impeller 1 leads to various amounts of the passing fuel or to various pressure build ups. The specifically good hydraulic characteristics of the pump are obtained when the axial distance $t_1$ and the radial distance $t_z$ are approximately equal, and the cross-sectional area S is approximately uniformly distributed about the periphery of impeller 1.

In the exemplified embodiment of FIG. 3 the second geometric characteristic or index $R_s$ reaches 1.4 and the third geometric characteristic or index reaches 1.1. Therefore, on the scale M 10:1, width B=3.5 mm, dimension E=2.5 mm and the interval $t_1=t_2=1$ mm. If the shape of the fuel feeding passage is modified and is as shown by reference character 26, the third geometric characteristic or index $R_a$ is about 0.5. The present invention provides for predetermined limitations of the dimensions of the pumps operated according to the WESTSO principle, which limitations ensure an optimal operation of the pump.

In contrast with the dimensions of the fuel-feeding passage 2 of the known pump of FIG. 1, geometric characteristic or ratio $R_S$ is 4.8 with width B=6 mm and dimension E=1.25 mm and ratio $R_a=3.2$ with distance $t_1=t_2=1$ mm, while, for the configuration of the fuel feeding passage of FIG. 2, ratio $R_S=0.27$ with width B=1 mm and dimension E=3.75 mm, and ratio $R_a=0.36$ with distance $t_1=1$ mm and distance $t_2=0.9$ mm; the dimensions of the fuel-feeding passage of FIG. 2 also lead to unfavorable hydraulic characteristics of the pump.

It will be understood that each of the elements described above, or two or more together, may also find a useful application in other types of fuel feeding aggregates, differing from the types described above.

While the invention has been illustrated and described as embodied in a fuel feeding aggregate, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a fuel-pumping aggregate of the type having a housing accommodating drive means and pump means driven by said drive means and operated according to the peripheral principle, said pump means including a rotatable impeller having a central axis and an outer peripheral portion having a periphery, said outer peripheral portion being provided with a plurality of vanes uniformly spaced from each other, said housing having an inner wall, said outer peripheral portion extending towards said inner wall and being spaced therefrom so that a fuel-feeding passage is defined therebetween, said outer portion being immersed into said fuel feeding passage a distance corresponding to the height of each vane so that said inner housing portion in the region of said passage has an axial wall portion extended in the axial direction of the impeller and two lateral wall portions extended in the radial direction of the impeller, and wherein hydraulic characteristics of said pump means are defined by a first pump geometric characteristic $R_m=S/L$ lying within the range of approximately from 0.4 to 2 mm, wherein S is a cross-sectional area of a space enclosed between the inner wall of the housing and the periphery of said outer portion and L is the length of the periphery of said outer portion, the improvement comprising that hydraulic characteristics of said pump means are further defined by a second pump geometric characteristic $R_s=B/E$ and a third pump geometric characteristic $R_a=A_2/A_1$ which lie within the range of approximately 0.5 to 1.5, wherein B is the width of the impeller in the axial direction thereof, E is the height of each vane, $A_1$ is the sum of the cross-sectional areas of two lateral portions of said space, extended laterally of said outer portion of the impeller; and $A_2$ is the cross-sectional area of a remaining portion of said space, the cross-sectional area of each of said two lateral portions being defined by the product of the height of the vane and a distance $t_1$, defined in said axial direction between the impeller and one of said lateral wall portions, and the cross-sectional area $A_2$ being defined by the product of a distance $t_2$ defined in said radial direction between an end radial face of the impeller and said axial wall portion, and the sum of the width of the impeller and two distances $t_1$.

2. The pumping aggregate as defined in claim 1, wherein the distance $t_1$ and the distance $t_2$ are approximately equal to each other.

* * * * *